United States Patent [19]

Walters

[11] Patent Number: 4,773,309

[45] Date of Patent: Sep. 27, 1988

[54] HEATING AND AIR CONDITIONING SYSTEM INCORPORATING CONTAMINANT CONTROL

[76] Inventor: Lonnie D. Walters, 7641 Blossomview Ct., Dayton, Ohio 45424

[21] Appl. No.: 40,179

[22] Filed: Apr. 17, 1987

[51] Int. Cl.[4] ..... F24F 7/00

[52] U.S. Cl. ..... 98/31.6; 98/31; 98/34.6; 237/46

[58] Field of Search ..... 98/1.5, 31, 31.5, 31.6, 98/34.5, 34.6; 237/52, 55, 46; 126/117; 165/48.1

[56] References Cited

U.S. PATENT DOCUMENTS

| | | | |
|---|---|---|---|
| 1,846,875 | 2/1932 | Karr et al. | 98/34.6 |
| 1,916,908 | 7/1933 | Stacey, Jr. et al. | 98/34.6 |
| 1,977,315 | 10/1934 | Lewis | 98/34.6 |
| 2,118,949 | 5/1938 | Scott | 98/34.6 |
| 2,669,393 | 2/1954 | Schleicher | 98/31.6 |
| 4,407,185 | 10/1983 | Haines et al. | 98/34.5 |

FOREIGN PATENT DOCUMENTS

| | | | |
|---|---|---|---|
| 1109011 | 1/1956 | France | 98/34.6 |
| 664764 | 1/1952 | United Kingdom | 98/34.6 |

*Primary Examiner*—James C. Yeung
*Attorney, Agent, or Firm*—Jerome P. Bloom

[57] ABSTRACT

Method, system and apparatus particularly advantageous for reducing the level of irritants and life threatening contaminants which exist in air within houses and other buildings the interior of which presents a relatively sealed environment. The embodiment illustrated exhibits ductwork defining a controlled flow path having an inlet or inlets arranged to communicate the interior of the living and/or working quarters of such a building with said path as well as outlet(s) therefrom to said quarters. Disposed in connection with said path are a blower for inducing a controlled flow of contaminated air from said living and/or working quarters to and through said path and series related temperature conditioning devices. Other devices communicated with said path are respectively constructed and arranged for the extraction from said path of a portion of such contaminated air as may be flowing therethrough at any given time and the discharge thereof to an environment exterior to said building and for the introduction to the flow in said path of a given quantity of fresh air in conjunction therewith. The method of the invention is such that, as long as the apparatus is energized, contaminated air withdrawn from the interior of the building is so processed in said flow path and in the delivery of the resulting air product that air in said building is significantly improved and rendered safe to breathe.

24 Claims, 1 Drawing Sheet

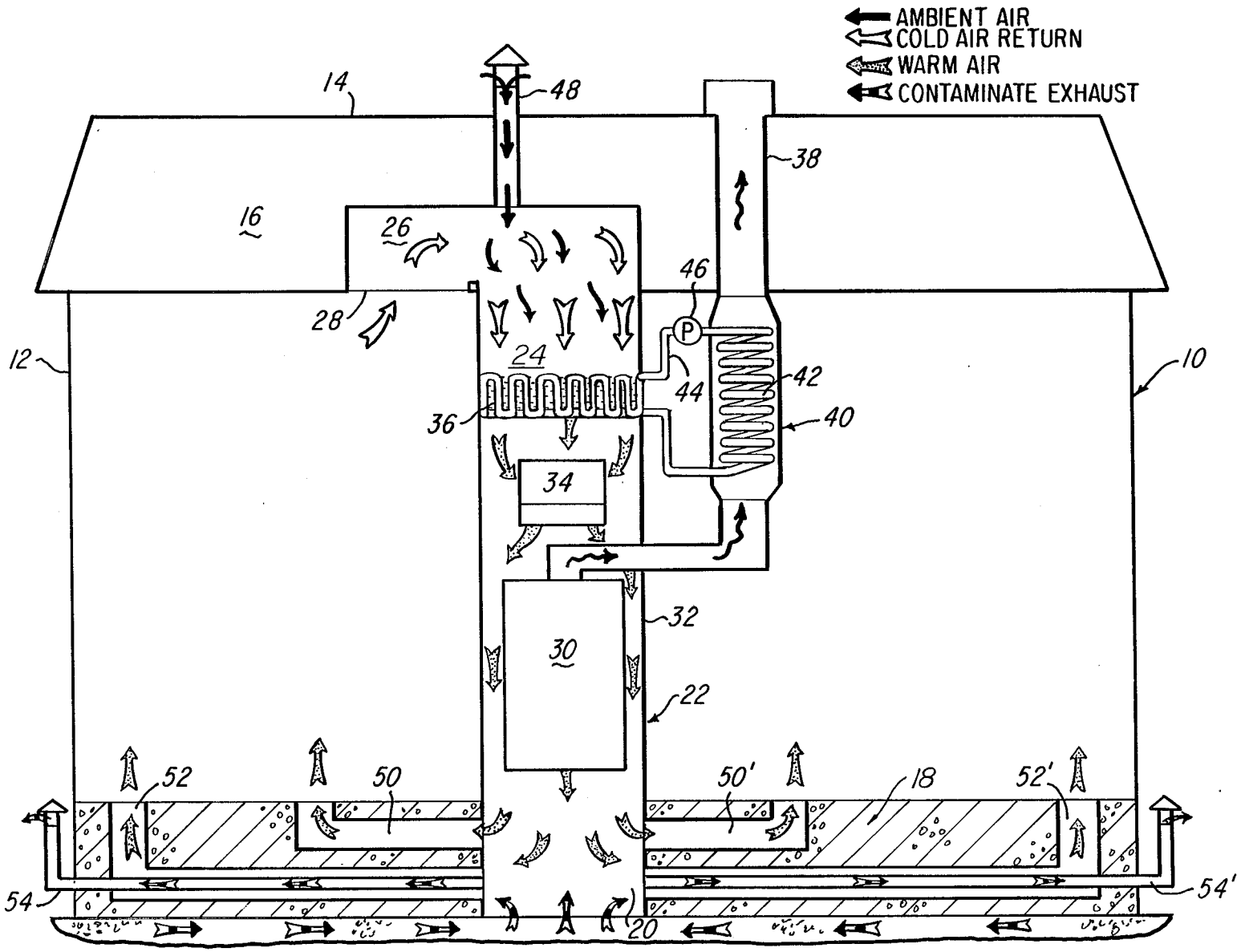
AMBIENT AIR
COLD AIR RETURN
WARM AIR
CONTAMINATE EXHAUST
10
12
14
16
18
20
22
24
26
28
30
32
34
36
38
40
42
44
46
48
50
50'
52
52'
54
54'
P

HEATING AND AIR CONDITIONING SYSTEM INCORPORATING CONTAMINANT CONTROL

BACKGROUND OF THE INVENTION

This invention relates to air conditioning and more particularly to a new and improved system, method and apparatus for controlling and significantly reducing the dangerous levels of gaseous contaminants and irritant particles which have been found to exist in the air which we breathe in a multitude of residential and commercial buildings.

It is herein illustrated and demonstrated, by way of example only, and not by way of limitation as to the form of its embodiment, its execution or its application, as providing a significantly improved heating and air conditioning system for a home.

The importance of this invention is that it addresses and solves a serious ongoing problem now being expressed in every type of public media, namely that the air which many of us breathe in our home and workplace is becoming so contaminated that not only our health but our lives may be threatened. That previously proposed solutions of this problem have been either unsatisfactory, inadequate or impractical is substantiated by the fact that there is at this time a substantial and ever increasing volume of public reports and warnings which confirm the continuance and increasing level of said problem.

Particular concern has been expressed for the extent to which the gaseous contaminant Radon and its daughters have insidiously infiltrated an extremely large number of homes in this country. This has been fueled by publication of results of relatively recent scientific investigations which reveal the fact that the highly dangerous Radon gas and its daughters has now been found to exist in the air circulating in many private homes and other places of human habitation at a level which is many times that which is considered unsafe.

Based on information received, Radon is a radioactive gaseous element which is a derivative of the decay of uranium, traces of which may be found in almost any soil. Apparently as long as this substance remains within the ground or escapes into the atmosphere there is little concern for its existence. However, it has been established in scientific research that once a house or other building is constructed, Radon gas seeking to escape from the ground thereunder will enter such house or other building through the various cracks and apertures that inherently exist or occur in what may be considered its foundation structure. Houses and other buildings are normally constructed to provide them with a substantially sealed interior environment and their heating and air conditioning systems are normally so designed to inherently dictate a substantially closed interior loop through which the air therein is circulated. Within such a loop little occurs other than a limited heating or cooling and relatively low efficiency filtering of that air which passes therethrough. It is such an environment that Radon and its daughters enter, in the process of which to attach themselves to smoke and dust particles which accrue in the air thereof. This is additive to the various other contaminants known to exist in such air but in and of itself contributes heavily to a resultant toxic effect of the so contaminated air upon those breathing it. It should be obvious therefrom particularly given a continuous infiltration of the air of such a house or building by the colorless and odorless contaminants Radon and its daughters that its inhabitants will soon be exposed to and breathing contaminants of such a level and of such a nature that they will experience deterioration of their health and eventually find themselves afflicted with disease such as lung cancer or worse.

In addition to providing an effective solution to the serious problem posed, embodiments of the present invention are simple and economical to fabricate and install, adaptable to a wide variety of application and most efficient and satisfactory in use. At the same time the method of the invention is not only simple and economical to execute but achieves its objective in a manner to enhance the efficiency of any heating and/or air conditioning system to which it applies. Most importantly the invention exhibits a practicality in its use and application.

As far as the inventor and others substantively involved in the present disclosure are aware, the state of the relevant prior art is best represented in the October 1986 edition of Consumers Research Magazine.

SUMMARY OF THE DISCLOSURE

An embodiment of the present invention provides a simplistic system and apparatus for and method of controlling and significantly reducing the amount of life threatening contaminants usually found to exist in the air within the interior of a house or other building the living and working areas of which are relatively sealed.

The method of the present invention basically comprises the steps of inducing a relatively metered flow of contaminated air from the interior of a house or other building, the living and working quarters of which are relatively sealed, directing said metered flow of contaminated air into and through at least a portion of a defined flow path, in the process of flow of air through said path extracting from said path a portion of such contaminated air as is moving therethrough at the point of said extraction, introducing to said path a proportional quantity of fresh air to enter and blend into that air which is moving through said path at the point of the entry thereof, modifying the temperature of air during the course of its movement through said path and returning to said interior of the house or other building from which contaminated air flows into said path in the first instance a substitute quantity of air conditioned as to its temperature, substantially freshened and having a appreciably reduced contaminant level.

In one form of embodiment, the system and apparatus of the invention comprises means directing a controlled flow of contaminated air from the interior of living and/or working quarters of a building into and through at least a portion of a defined flow path, means defining said path leading from and back to the interior of said building and said living and/or working quarters thereof, heat transfer means for modifying the temperature of air in the course of its movement through said path, means in communication with said path to direct therein a quantity of fresh air to intermix with and blend into air within and moving through said path, means to direct at least a portion of such contaminated air as may flow through said path from said path to a point exterior to said building to produce thereby a resultant air product which is freshened, the contaminant level of which is significantly less than that of the air previously drawn into the path from the interior of said building, and means for directing said resultant product, which is in an oxygen enriched state, to said living and/or working areas of said building as a replacement, at least in part, for contaminated air withdrawn therefrom.

In a preferred embodiment and practice of this invention said fresh air is ambient air and the means which directs this air into said path is constructed and arranged to cause such fresh air to intermingle with said contaminated air prior to the time it is subjected to said heat transfer means. In a further preferred embodiment this construction and arrangement is so governed that the amount and rate of flow of the incoming fresh air substantially equals that of said portion of contaminated air which is being directed to a point exterior to said building.

In any practice of this invention, during any period of time within which an invention embodiment is rendered operative, the extraction of contaminated air from said working and living quarters and a replacement thereof as herein described will normally occur simultaneously and in a continuing fashion.

In a particularly preferred embodiment thereof said means to direct contaminated air from said path to a point exterior to said building will be located at a point immediately preceding that point at which said replacement air enters the living and/or working quarters of the building which it services.

A further embodiment of the invention for use in reducing the level of irritants and life threatening contaminants normally found to exist in the air within a residential, commercial or other building having a relatively sealed interior environment provides a heating and/or air conditioning system embodied in connection with means defining an air flow path within said building which is distinct from its living and working areas. Means within and applied to said path are respectively operative to induce the movement of contaminated air and direct flow of fresh air to said path, respectively from interior living and working areas of said building and a source exterior to said building. Further located within said path are series related heat transfer means constructed and arranged to modify the temperature of air moving through said path. Means are additionally applied to withdraw from said path a portion of that contaminated air drawn thereto from the interior of said building and discharge it to the environment exterior to said building in concert with the introduction of fresh air to said path. Said means within and applied to said contaminated air in the course of its movement through said path mutually function to produce within said path a resultant air product which is returned to the living and working areas of said building in a condition to significantly upgrade the quality of air therein and render it quite safe for breathing.

It is a primary object of the invention to provide a highly effective yet simple method, system and apparatus for relieving the air within the interior of an inhabited building of as much as possible of the contaminants therein which are dangerous to and threaten the health, welfare and/or life of its inhabitants.

A further object to provide such a method, system and apparatus which is easy and economical to execute and fabricate and more efficient and satisfactory in use than those heretofore proposed for such an application.

Another object of the invention is to provide a new and improved heating and air conditioning system embodying the above stated features and capable of achieving the above stated objectives.

An additional object of the invention is to provide a method, system and apparatus for use in controlling and/or reducing the level of life threatening contaminants normally found in the air within a residential or commercial building or the like possessing the advantageous features, the inherent characteristics and the means and mode of application herein described With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

The present invention is herein illustrated by way of example and not by way of limitation with reference to the single FIGURE of the accompanying drawing wherein it is shown as embodied in the format of a heating and air conditioning installation and demonstrated as to its features and function as part of, a slab type single level house.

DESCRIPTION OF THE INVENTION

The illustrative embodiment of the invention shown in the drawing is incorporated in a one story house 10 of a type widely used as a single family residence. Such house is conventionally enclosed at its outer periphery by four walls 12 capped at their upper limits by a roof 14. Immediately under roof 14 and over the ceiling structure 28 defining the upper limit of the living and working area of the house 10 is an attic 16. The walls 12 are secured to rise from and perpendicular to the base of the housing 10 which is, in this case, a poured concrete slab 18 firmly and stably set on, integrated with and anchored to a peripherally coextensive perpendicularly related dependent footer which has been previously set to nest in a trench formed in the underlying ground surface.

The footer is so formed as to position the upper surface of slab 18 above, adjacent and in a vertically spaced relation to the ground over which it sets. Interposed between that portion of the undersurface of slab 18 bounded by an upper portion of said peripheral footer and the ground surface immediately thereunder, prior to the pouring of the slab, is a layer of sand and gravel within which are lodged several lengths of pipe and ductwork arranged to form predetermined parts of the plumbing and heating (and air conditioning, if any) systems of the house. Attention is directed to the fact that the pipes related to the plumbing system are not shown since in and of themselves they are not specifically pertinent to the subject invention or its disclosure. As normally provided and here illustrated a generally central opening made in slab 18 in the pouring thereof accommodates the projection therethrough of the upper end portion of a warm air plenum 20 forming part of the heating system of the house 10. The plenum 20 nests in the underlayer of sand and gravel to seat to the ground surface thereunder and rise perpendicular thereto, at least to the upper level of the slab 18.

As shown, plenum 20 is connected with and forms a directly aligned lower extension of a furnace 22 in the house 10 which rises upwardly therefrom and perpendicular to the upper surface of the slab 18.

The peripheral wall of plenum 20 is provided with a number of circumferentially spaced openings in each of which is set one end of one of the ducts 50, 50', 52, 52' of which the aforementioned ductwork is comprised.

While shown in the drawing on different levels for convenience of their disclosure in diagrammatic form, all of the ducts 50, 52, 50' and 52' are, in fact, on essentially the same level. Each said duct is distinctively set to open at one end to the chamber defined by the plenum 20 and have its other open end continued by a vertically directed extension thereof lodged in an opening in the slab 18 and opening at its upper surface to a particular living or working area within the house 10 the floor of which is provided by the slab 18. As will be seen, the plenum 20 and the communicated ducts form an essential part of the illustrated heating system (and correspondingly would form a part of an interrelated air conditioning unit should such be installed in the house 10). The upper end of the plenum 20 opens to and is in direct communication with the interior of the shell-like housing 32 of the furnace 22 by way of an opening in its bottom.

Mounted above the furnace 22 to form a duct-like vertical extension of its housing 32 is a cold air plenum 24. The latter projects upwardly through an opening in the ceiling structure 28 into the attic of the house 10 within which it opens to, connects with and is continued by laterally extending ductwork 26. The ceiling structure 28, within each individual living or working area of the house 10, has therein an opening to a portion of the ductwork 26 which is bridged by a grill through which air may be vented or otherwise drawn from the living and working areas to the interior of said ductwork 26 in a manner and by means to be further described.

As may be seen from its diagrammatic illustration in the drawing, furnace 22 is basically comprised of what may be considered a heat exchanger 30 positioned in, centrally of and in peripherally spaced relation to the shell 32 which defines its housing, the upper end of which is extended by plenum 24 and the lower end of which by plenum 20. As should be obvious, the heat exchanger 30 comprises the burner and combustion chamber of the furnace, the fuel of which is in this instance contemplated as natural gas. Positioned immediately above the furnace, in what may be considered the lower portion of the plenum 24, is a blower 34. Upstream of the blower 34, in vertically spaced relation thereto, is a further heat exchanger 36 which bridges the interior of the plenum 24 at a location adjacent but vertically spaced from and below the level of the ceiling 28.

A flue 38 through which hot gases of combustion and particles therein are evacuated from the combustion chamber of the heat exchanger 30 to the atmosphere above the house 10 has one end thereof connected to open to the interior of said combustion chamber of the heat exchanger 30. Immediately of the furnace the flue 38 extends outwardly of the furnace housing 32 and to one side of the furnace, from which point it is then extended vertically upward in the process of which to position in a relatively adjacent spaced parallel relation to plenum 24 to and through an opening in ceiling 28, attic 16, an appropriate opening in the roof 14 and upwardly therefrom to a point sufficiently displaced from the roof to insure that gases and entrained particles developed in the combustion chamber of the furnace may be carried away by the flue 38 and safely discharged to the atmosphere clear of the house 10.

Note that one portion of the length of the vertical extent of flue 38 is a separable section 40 which intermediate its ends is increased as to its internal diameter for the major portion of its length. Contained within said increased internal diameter portion, in concentrally spaced relation to its inner surface is a heat transfer coil 42 the respective ends of which project laterally and radially outward from the section 40 in the direction of the plenum 24 to respectively connect to and be integrally joined to the respective ends of a further heat transfer coil which defines heat exchanger 36. The heat exchanger 36 horizontally bridges the plenum 24 and is so positioned in the case illustrated substantially at right angles to the coil 42, in a line which falls intermediate its ends. Thus, heat transfer coil 42 and the coil defining the heat exchanger 36 are in fact defined segments of one continuous coil 44 which in cross section is tubular and contains therein in this application a heat transfer substance such as water, glycol or antifreeze. A pump 46 inserted in the length of the coil 44 between the flue 38 and the ductwork defining the plenum 24 serves to provide for a continuing circulation, as and when required, of the heat exchange fluid which coil 44 contains.

Also included in the illustrated system is a vertically oriented pipe section 48 one end of which opens into the upper end of the duct 24, from which point the pipe 48 extends to and through the attic 16 and the roof 14 to have the opposite end thereof position at a location spaced above the roof and in open communication with the ambient air of the environment which is exterior to said house.

Referring once more to slab 18 and the duct sections therein forming part of the heating system of the present invention, positioned within and in concentrically spaced relation to each of the ducts 52 and 52' is a small diameter pipe, respectively 54 and 54'. As seen, each of said pipes has one end thereof open to the plenum 20 commonly with the duct through which it extends and the opposite open end portion thereof projected through and outwardly from the footer which underlies, supports and is bridged by the slab 18. Outwardly of and spaced from the footer each of the pipes 54 and 54' is continued by an upwardly directed rignt angled extension the outer open end of which is capped for a discharge of that gaseous material which is moved therethrough outwardly of and away from the house 10 in the execution of the method and operation of the system and apparatus which is the subject of this disclosure.

In its illustrated embodiment the system of the invention is adapted to a forced air heating system utilizing a furnace 22 of a counterflow type. This system will function irrespective of the source of the energy used to produce the heat which is required to service the house to which it applies.

It should be kept in mind that during each day in the operation of the illustrated system, which may be arranged to be conventionally thermostat controlled, it will be energized and rendered operational a number of times and during each interval of its operation on a continuing basis.

Each time the thermostat signals a requirement for further delivery of heat to the interior of the house 10, the furnace 22 kicks on, fuel is delivered and combustion takes place in the combustion chamber of the heat exchanger 30. Heat developed in the process is transmitted to and reflected by an increasing temperature of the exterior of the heat exchanger 30. At the same time the hot exhaust gases of combustion which would normally result in wasted heat exit from the combustion chamber and move upwardly of the flue 38 to and through the expanded section 40 thereof to pass to, through and about the coil 42. The coil 44 is made of a heat transfer material which provides that a significant portion of this heat is transmitted to the heat transfer medium within the section 42 thereof. By virtue of the energization of the pump 46 the contents of the coil portion 42 which are being constantly heated by gases of combustion exhausted through the flue 38 are then pumped through the coil 44 to transfer heat content thereof to the coil defining the heat exchanger 36 in passage therethrough back to the coil 42 for a reheating thereof in cyclic fashion as long as the heat exchanger 30 is operational.

As would be the case in a conventional thermostat system of controls, the blower 34 is energized simultaneously with the energization of heat exchanger 30. Once the blower is energized, it automatically applies suction in the plenum 24 and the interconnecting ductwork 26 and by way of vents in the ceiling 28 to contaminated stale air within living and working areas of the house 10. The effect of this is to induce flow of a measurable portion of said contaminated air into and through the ductwork 26 to and downwardly of the chamber defined by the plenum 24. As the so withdrawn contaminated air moves through duct 26 to plenum 24 it passes the lower open end of the fresh air intake pipe 48 and together with the suction effect so applied to the pipe 48 influences, in accordance with the effect of the pumping action of the blower 34, an inflow thereto and an intermixture therewith of the volume of fresh air drawn from the environment exterior to the house 10. By the time it reaches and enters the upper end of the plenum 24 the air drawn from the living area of the house 10 is supplemented, freshened and oxygen enriched, in the process of which to inherently reduce, to a limited extent, the proportional level of contaminants in the resulting mixture as contrasted to that of the air withdrawn from the interior of the house.

This oxygen enriched air is drawn down over and through the portion of the coil 36 which bridges the plenum 24 in the process of which to extract heat therefrom. The intermingled contaminated and fresh air is thereby preheated prior to its passage to and past the blower and the entry thereof to the upper end of the furnace 22 as shown in the accompanying drawing. As will be obvious, the air previously moved by suction on the up side of the blower is now propelled by the blower 34 under pressure. As will be seen this preheated air, delivered under pressure, is now moved down through the passage defined between the furnace heat exchanger 30 and the shell defining its housing in the course of which to extract heat from the heat exchanger 30 the temperature level of which at this time is substantially eleveated. This secondary heating of the flow of air through the path defined by conduit 26, plenum 24 and furnace 22 will result in this air being so conditioned as to its temperature as to respond to the demands therefor signalled through a thermostat by one of the inhabitants of the house 10.

The so conditioned and heated air then moves into and fills the plenum 20 and under the influence of the flow thereabove and the pressure thereon establishes therein a head of static pressure. Under the influence of the static pressure portions of air directed to the plenum 20 will be directed in a pressured flow back to living and working areas of the house 10 by way of the ducts 50, 50', 52 and 52'. At the same time significant amounts of the air reaching the plenum 20 and the contaminant content thereof, along with radon and its daughters therein and in process of infiltrating the house, as seen in the drawing, will be naturally intercepted and carried away by the small diameter pipes 54 and 54' and discharged at the exterior of the house. This last is heavily influenced by the pressure differential which exists between that in the plenum 20 and the considerably lower pressure of the atmosphere exterior to the house as well as the well known fact that the radon gas and its daughters will follow the path of least resistance.

Particular attention is directed to the fact that the system provided by the invention is essentially balanced. The form and nature of the pipes 54 and 54', that of fresh air inflow pipe 48 and the parameters of operation of the blower 34 are such to provide that the amount of fresh air intake will substantially equal the amount of contaminated air being evacuated through the pipes 54 and 54' during any given period that the system is energized. This accompanied by the staged preheating of the air moving through the defined flow path to which contaminated air is drawn from the house 10 for its processing as described insures that no extra load is placed on the heating system by reason of its modification to include the significant features, factors and highly significant and beneficial results of the use of the present invention. Not only is the invention embodiment and practice reduced to a most simplistic level but it is most economical as to capital equipment and the cost of its use is so insignificant as to add little burden on the householder or any other building owner acquiring its important benefits.

There is of course, as previously indicated, a continuous withdrawal of contaminated air from the interior or the living and working areas of the house during each single interval of time that the system is energized. At the same time within any such period of energization and in the movement of any given quantity of contaminated air drawn from the house through the described flow path there is a blending therewith of fresh air and its oxygenation, a staged preheating of the air and an extraction therefrom of a portion thereof which incorporates a significant fraction of the contaminants in the air withdrawn from the house for this treatment. By virtue of each such cycle per the invention, original contaminated air is replaced by substantially equal amounts of air returned to the living and working areas of the house to blend with the air in the whole house thereby to reduce the general level of contaminants therein. The use of the invention not only achieves in an improvement of air quality within a building over a relatively short period of time but also results in the maintenance of quality of the air therein at a level which renders it safe for its occupants to breathe.

Thus, the environmental protection benefits of the present invention, simplistic as it is, clearly establish that the problem which the invention has addressed has been effectively solved to a degree that the invention is a significant contribution to the art.

As should be self evident, the method, system and apparatus of the invention as above described is readily adaptable and applicable in similar manner to any building whether it has a counterflow furnace as in the illustration described, an upflow or any other type of furnace, and irrespective of the source of energy used for preheating and heating air. The benefits of the invention are similarly applicable in a system for cooling the temperature of air in a building. The only difference is in the temperature conditioning of the air being processed.

Contamination of the air being processed can be just as readily and cheaply reduced during a period of air cooling in a manner similar to that herein described with reference to a period of time during which heating of inferior air is required for comfort of the inhabitants of the building to which the system is applied.

From the above description it will be apparent that there is thus provided a device of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims which represent embodiments of the invention in which an exclusive property or privilege is claimed. It is to be understood and it is intended that the substance and form of the appended claims are included in and form a part of the present original disclosure of the subject invention.

Having thus described my invention, I claim:

1. A method of reducing the level of irritants and other more threatening contaminants which exist in the air within a house or other building the interior of which presents a relatively sealed environment, which building has in connection therewith a temperature modifying unit, comprising the steps of inducing a flow of contaminated air from an interior area of said building and the movement thereof through a defined flow path within a portion of which said temperature modifying unit is located, in the course of the flow of said contaminated air in said path and at a point prior to its reaching said temperature modifying unit directing therein and intermingling therewith a given quantity of fresh air drawn from the environment exterior to said building, relatively immediately thereafter subjecting said flow of intermingled contaminated air and fresh air in said path to a modification of its temperature to produce thereby a resulting air product freshened and supplemented by the addition thereto of fresh oxygen and having a relatively reduced level of contaminants rendering it safer to breathe as contrasted to the quality of the contaminated air moving into said flow path from said area of said building, inducing said resulting air product to flow to and beyond said temperature modifying unit in heat exchange relation thereto to further modify its temperature and thereafter directing a quantity of the resulting air product to said interior area of said building to serve as a replacement for an amount of the more contaminated air previously induced to flow therefrom.

2. A method as in claim 1 characterized in that at a point subsequent to a modification of the temperature of the flow of said intermingled air through said path extracting therefrom a portion of the contaminated air therein and directing it to an environment exterior to said building.

3. A method as in claim 1 characterized by maintaining a substantial balance between the amount of contaminated air directed from the interior of said building into said flow path and the amount of said resulting product directed from said flow path into the interior of said building at any given time during the application of said method to said building.

4. A method as in claim 1 characterized in that said further modification of the temperature of said resulting air product is effected substantially immediately following its first modification in the course of its movement through said path.

5. A method of reducing the level of irritants and other more threatening contaminants which exist in the air within a house or other building having in connection therewith a heating and/or cooling unit, including inducing a flow of contaminated air from the interior of such a building to and at least in part through a defined flow path within which said heating and/or cooling unit is located, said path having one or more outlets for return to said interior of said building of replacement air; in the course of said flow of contaminated air in said path directing therein a given quantity of fresh air, naturally including fresh oxygen, to intermingle therewith; subjecting such intermingled air moving through said path to a modification of its temperature in the course of its movement to and past limited portions of said heating and/or cooling unit, and beyond said heating and/or cooling unit effecting a division of the ensuing product and in part directing it to the interior of said building by way of one or more of said outlets as a replacement for a quantity of contaminated air previously induced to flow from said interior of said building to said flow path for the treatment thereof as described and in part directing it to an environment exterior to said building, in the process of which to gradually and effectively reduce the amount of contaminants in the air within the interior of said buiding and, as long as the method is applied to the building, on a continuing basis.

6. A method according to claim 5 characterized by maintaining, substantially, a balance between the quantity of fresh air which is directed into said path and the quantity of contaminated air removed therefrom.

7. A method such as set forth in claim 5 wherein the division of said ensuing product is effected in the course of a movement thereof in the direction of one or more of said outlets by intercepting a part thereof and channelling said intercepted part in a continuing flow directly to an environment exterior to said building.

8. A method as in claim 5 wherein, in the course of the application thereof to said building, said given quantity of fresh air is directed into said flow path to blend into and intermix with the contaminated air moving into said flow path at point relatively closely spaced from the point of entry of said contaminated air to said path and prior to the modification of the temperature of either thereof, and subsequent thereto this intermixed air is subjected to a temperature modification as a composite.

9. A method as in claim 5 characterized in that in use of said unit in a heating mode said intermingled air is subjected to a series related modification of its temperature by first utilizing waste heat derived from the energization of said unit in a heating mode and subsequently utilizing said unit per se.

10. A method as in claim 9 characterized by subjecting said fresh air to a temperature modification shortly after its entrance to said flow path and during the application of said method maintaining a balance as between inducing the flow of contaminated air from the interior of said building and directing a replacement thereof by said resulting air product.

11. A method of reducing the level of irritants and life threatening contaminants which exist in the air within a house or other building the interior of which presents a relatively sealed environment and has connected therewith temperature modifying means comprising the steps of periodically inducing a relatively controlled flow of contaminated air from the interior of the living and working quarters of such a building into and its movement through at a defined flow path leading back to said living and/or working quarters, within which path said temperature modifying means is positioned; in the course of the movement of said contaminated air through said path and at a point within said path downstream from its entrance thereto extracting from said path a portion of the flow therein including a portion of the contaminated air moving therethrough and discharging it into the environment exterior to said building while at the same time inducing the entry to said path and the air therein of a relatively controlled proportional quantity of fresh air, and modifying the temperature of air moving through said path, by virtue of which to produce a resultingly highly improved air product exiting from said flow path to the interior of said living and working quarters of the building in an amount to substantially replace contaminated air which is leaving said living and working quarters.

12. A method according to claim 11 characterized by inducing the entry of said relatively controlled proportional quantity of fresh air to blend with the contaminated air in said path shortly following its entrance thereto and prior to a modifying of the temperature thereof.

13. A method according to claim 11 characterized by effecting said extraction of contaminated air from said path substantially immediately of the finalization and exiting of said improved air product to the interior of said living and working quarters of said building.

14. System and apparatus particularly advantageous for use in reducing the level of irritants and life threatening contaminants which exist in the air within a house or other building the interior of which presents a relatively sealed environment comprising means defining a controlled flow path extending from the interior of said building and leading back thereto, said means defining said path having at least one inlet thereto from living and/or working quarters provided in said building, means for inducing a controlled flow of contaminated air from said living and/or working quarters, by way of said inlet, to and through said defined flow path, further means in communication with said path constructed and arranged for the introduction to the flow therein, in the course of its movement therethrough, of a quantity of fresh air, temperature modifying means interposed, at least in part, within said path, to modify the temperature of the flow in the course of its movement through said path, means to direct from said path, to an environment exterior to said building, a portion of such contaminated air as may be flowing therethrough at any given time, additional means in connection with said path operative to subject the flow therein to a modification of its temperature in the course of its movement through said path and means constructed and arranged to define an exit to deliver from said path to said living and/or working quarters that product which results from the application of said means to the contaminated air which is introduced to and flows through said path, to thereby effect a continuing improvement in the quality of the air in said living and/or working quarters.

15. A system and apparatus according to claim 14 wherein said temperature modifying means are series related and said means to direct contaminated air from said path to an environment exterior to said building is in following relation to said series related temperature modifying means.

16. A system and apparatus according to claim 14 wherein said further means is constructed and arranged to communicate with said flow path to introduce said fresh air to merge into the controlled flow of contaminated air from said living and/or working quarters at a point in advance of the exposure of said flow to said temperature modifying means.

17. A system and apparatus according to claim 16 wherein said temperature modifying means comprise two successive temperature modifying means the first of which is located at least in part within said path at a point following the merging of said fresh air into said flow of contaminated air as it flows from said living and/or working quarters of said building.

18. A system and apparatus according to claim 14 wherein said temperature modifying means comprise two thereof a first of which is a preheater and the second of which is a primary heat exchanger which is in following relation to said preheater in the direction of movement of said flow within said path.

19. A system and apparatus according to claim 14 wherein said means in communication with said path for introducing fresh air thereto is located in and between remote portions of said path and at the same time constructed and arranged to induce a continuing controlled flow of contaminated air from said living and/or working quarters to and through said path to intermingle with said fresh air at a point in said path prior to said temperature modifying means and said means to direct contaminated air from said path to an environment exterior to said building is downstream thereof.

20. A system and apparatus according to claim 14 wherein said temperature modifying means comprise two successive temperature modifying means the first of which is a preconditioning means located to apply to the flow in said path at a point following the introduction of said fresh air into said flow of contaminated air from said living and/or working quarters of said building and the second of which is a primary temperature conditioning means.

21. A system and apparatus according to claim 20 wherein said first temperature modifying means constitute a preheater and said primary temperature conditioning means is provided by a furnace.

22. A system and apparatus according to claim 21 wherein said furnace includes a heat exchanger portion having a combustion chamber as part thereof and a flue pipe in connection therewith providing means for discharge of hot exhaust gases produced in the course of combustion in said chamber, and said preheater has an extension of at least a part thereof located in said flue pipe along a portion of the length thereof providing means to draw thereto waste heat passing through said flue pipe and continuously transfer heat thereof to said preheater during operation of said system and apparatus.

23. A system and apparatus according to claim 22 wherein said extension of said preheater has the form of a coil of tubing containing heat transfer fluid extended laterally to be continued by and form a part of said preheater which is at a location within said path.

24. A system and apparatus according to claim 14 wherein said means defining said controlled flow path include one or more duct portions in communication with various portions of the interior of said building through which contaminated air moves from said interior to said flow path and said means to direct from said path, to an environment exterior to said building, a portion of such contaminated air as may be flowing therethrough at any given time is provided by one or more pipes which are in direct communication with the environment exterior to said building.

* * * * *

UNITED STATES PATENT OFFICE

CERTIFICATE OF CORRECTION

Patent No. 4,773,309 Dated September 27, 1988

Inventor(s) Lonnie D. Walters

It is certified that error appears in the above-identified patent and that said Letters Patent are hereby corrected as shown below:

Col. 3, line 61, -- is -- is inserted following "object".

Col. 4, line 20, the comma therein is deleted.

Col. 6, line 2, "concentrally" is corrected to read -- concentrically --.

Col. 7, line 54, "eleveated" is corrected to read -- elevated --,
line 64, a comma is inserted following "pressure".

Col. 10, line 52, (claim 8, line 5) -- a -- is inserted following "at".

Col. 11, line 11, (claim 11, line 9) "at" is deleted.

Col. 6, line 41, "rignt" is corrected to read --right--.

Signed and Sealed this

Seventh Day of March, 1989

*Attest:*

DONALD J. QUIGG

*Attesting Officer*

*Commissioner of Patents and Trademarks*